US006899239B1

(12) United States Patent
Gray

(10) Patent No.: US 6,899,239 B1
(45) Date of Patent: May 31, 2005

(54) SEALABLE BABY BOTTLE LINER

(76) Inventor: Janice Gray, 1 Cherokee Bay, Winnipeg, Manitoba (CA), R2J 2C4

( * ) Notice: Subject to any disclaimer, the term of this patent is extended or adjusted under 35 U.S.C. 154(b) by 0 days.

(21) Appl. No.: 10/351,866

(22) Filed: Jan. 27, 2003

(51) Int. Cl.[7] ..... A61J 9/00; B65D 33/16
(52) U.S. Cl. ..... 215/11.3; 215/365; 383/63
(58) Field of Search ..... 215/11.3, 365; 383/63, 65, 10, 35

(56) References Cited

U.S. PATENT DOCUMENTS 3,204,855 A * 9/1965 Boynton et al. ..... 215/11.3
3,790,017 A * 2/1974 Fitzpatrick et al. ..... 215/11.3
3,834,570 A * 9/1974 Barr ..... 215/11.3
4,501,585 A * 2/1985 Friedman ..... 604/346
5,385,251 A * 1/1995 Dunn ..... 215/11.3
5,894,947 A * 4/1999 Morano ..... 215/11.3
6,328,082 B1 * 12/2001 Lafond ..... 141/313
6,576,278 B1 * 6/2003 Sprehe ..... 426/117

* cited by examiner

*Primary Examiner*—Jacob K. Ackun
*Assistant Examiner*—Faye Francis
(74) *Attorney, Agent, or Firm*—Michael I. Kroll

(57) ABSTRACT

A baby bottle liner having a containment body including an inner surface, an outer surface, a first open end, a second sealed end, a first sealed side extending between the first open end and the second closed end, and a second sealed side extending between the first open end and the second sealed end on a side opposite the first sealed side thereby forming a cavity. An interlocking seal is positioned adjacent the first open side operable between a first position sealing the cavity and a second position providing access to the cavity. A pair of tabs extend from the first open side of the containment body. Each of the tabs has an aperture extending there through. When the seal is in the first position an airtight container is formed preventing air from affecting liquid contained within the cavity. A perforation extending along a length of the containment body allows one to selectively separate the tabs from the containment body.

6 Claims, 9 Drawing Sheets

SEALABLE BABY BOTTLE LINER

BACKGROUND OF THE INVENTION

1. Field of the Invention

The present invention relates generally to baby bottles and, more specifically, to a sealable baby bottle liner having a cavity formed by a containment body composed of a pliable polymeric substance that allows for volumetric expansion and contraction of the cavity for placement of a desired beverage therein.

2. Description of the Prior Art

There are prior art baby bottle liners in existence, which provide reduced air introduction into beverage flow. While these baby bottle liners may be suitable for the purposes for which they where designed, they would not be as suitable for the purposes of the present invention as heretofore described. It is thus desirable to provide a baby bottle liner that, in addition to providing reduced air introduction, the liner is sealable. It is further desirable to provide a baby bottle liner with disposable tabs having an aperture for aiding in installation of the liner.

SUMMARY OF THE PRESENT INVENTION

The present invention relates generally to baby bottles and, more specifically, to a sealable baby bottle liner having a cavity formed by a containment body composed of a pliable polymeric substance that allows for volumetric expansion and contraction of the cavity for placement of a desired beverage therein.

A primary object of the present invention is to provide a baby bottle liner that overcomes the shortcomings of the prior art.

A further object of the present invention is to provide a baby bottle liner able to easily store breast milk or formula for freezing and/or traveling.

Another object of the present invention is to provide a baby bottle liner having an interlocking seal for selective storage and retention of a beverage or unused beverage for later use.

Yet another object of the present invention is to provide a baby bottle liner having disposable tabs to aid in installation of the liner into a baby bottle.

Still yet another object of the present invention is to provide baby bottle liner having disposable tabs with an aperture thereby providing a more graspable component.

Another object of the present invention is to provide a baby bottle liner having informative indicia embossed thereon.

Yet another object of the present invention is to provide a baby bottle liner able to form an airtight seal between a baby bottle and baby bottle cap preventing the introduction of air to the beverage flow.

Still yet another object of the present invention is to provide a baby bottle liner having a perforated strip to allow for easy removal of the disposable tabs after installation.

Another object of the present invention is to provide a baby bottle liner having a plurality of sizes constructed to accommodate different sized baby bottles.

A further object of the present invention is to provide a baby bottle liner that is simple and easy to use.

An even further object of the present invention is to provide a baby liner that is economical in cost t manufacture.

Additional objects of the present invention will appear as the description proceeds.

The present invention embodies a containment body consisting of a pliable polymeric substance. The containment body has a structure forming a cavity with an opening at one of its ends. The cavity is volumetrically expandable and contractible. An interlocking seal is located inward of the cavity opening, for selectively creating an airtight container for storing an unused beverage therein. The containment body has embossed on its exterior surface a plurality of informative indicia for providing information pertaining to the amount of fluid contained within the cavity, a date/time and name entry space, and installation instructions. The expandable material extends beyond the cavity opening thus forming tabs for aiding in the installation of the liner in a baby bottle. Further assistance is provided by an aperture placed therein, this makes handling the liner a much easier task.

Disposed between the containment body's cavity opening and disposable tab is a row of perforations produced to form a tear strip for easy detachment of the disposable tab from the containment body after installation.

Installation of the present invention is achieved by placing the containment body into a baby bottle, and then folding the containment body's open end over the bottle's opening in a manner that provides for placement of the baby bottle cap there over to form an airtight connection that causes the present invention to act as a baby bottle liner.

The present invention overcomes the shortcomings of the prior art by providing a baby bottle liner that is sealable and may be used to store a beverage or excess beverage for later use. Further, the present invention has perforated disposable tabs to aid in installation of the present invention to a baby bottle. Additionally, the containment body is embossed with informative indicia on its exterior surface and may be made in any of a plurality of sizes suitable for various sized baby bottles for the containment therein of a beverage.

When the present invention is installed, the disposable tabs are removed and an airtight seal is formed between the baby bottle and baby bottle cap, allowing reduction of internal pressure within the containment body when extrusion of the beverage is made through the nipple. This causes a deformation of the liner in correlation to the reduction of the volume inside the containment body effectively preventing the introduction of air into the beverage flow.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 1:
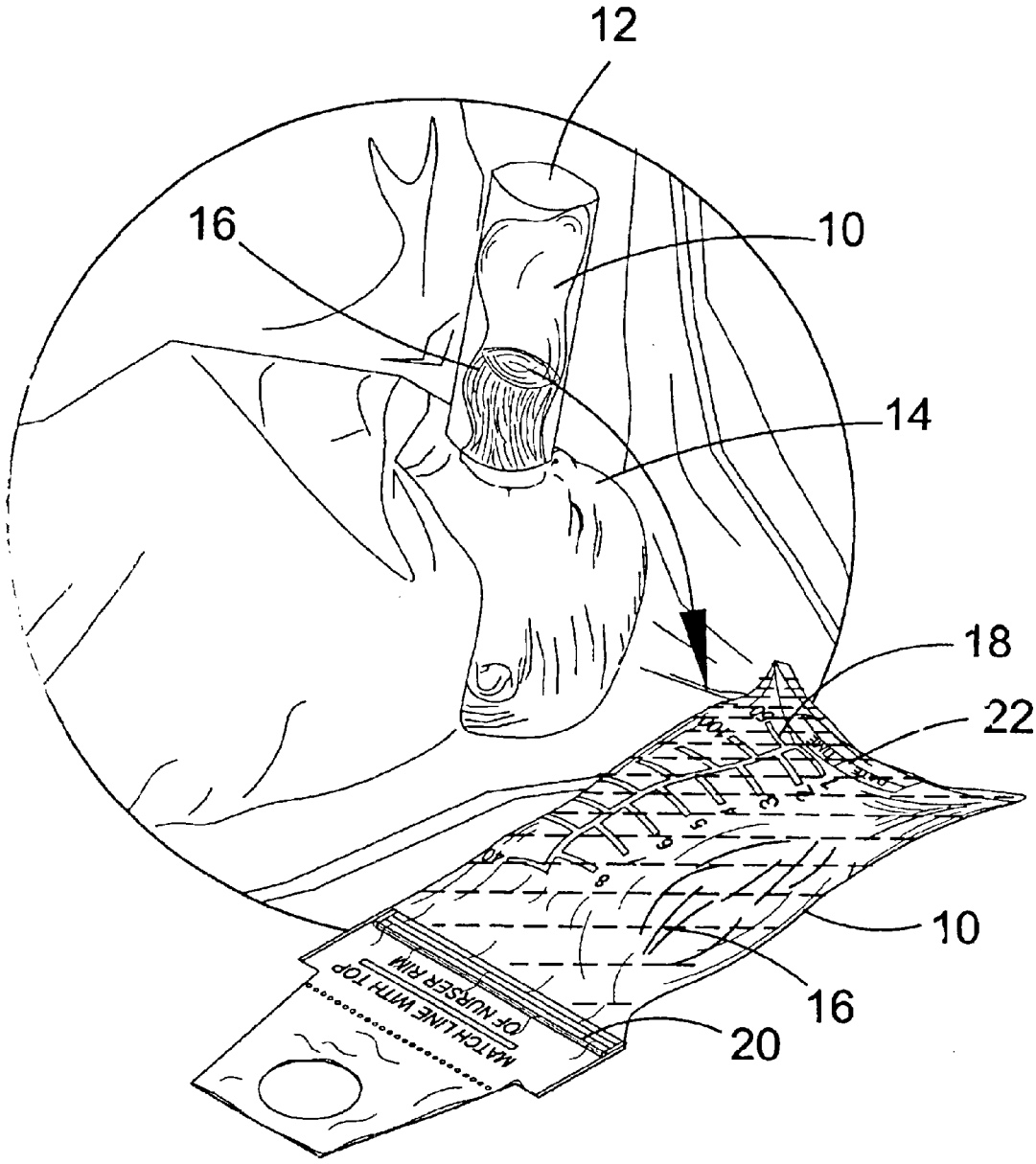
FIG. 1 is a perspective view of the sealable baby bottle liner of the present invention in use within a standard baby bottle for feeding an infant and an enlarged view of the baby bottle liner of the present invention.

The foregoing and other objects and advantages will appear from the description to follow. In the description, reference is made to the accompanying drawing, which forms a part hereof, and in which is shown by way of illustration specific embodiments in which the invention may be practiced. These embodiments will be described in sufficient detail to those skilled in the art to practice the invention, and it is to be understood that other embodiments may be utilized and that structural changes may be made without departing from the scope of. In the accompanying drawings, like reference characters designate the same or similar parts throughout the several views.

DESCRIPTION OF THE REFERENCED NUMERALS

Turning now descriptively to the drawings, in which similar reference characters denote similar elements throughout the several views, the Figures illustrate the sealable baby bottle lines of the present invention. With regard to the reference numerals used, the following numbering is used throughout the various drawing figures.

10 sealable baby bottle liner of the present invention
11 containment body
12 baby bottle
13 open end of cavity
14 baby
15 first side seal
16 right side seal
18 measurement scale
19 top of bottle reference line
20 interlocking seal
20 left side seal
22 ascribable indicia
23 bottle rim
24 perforated strip
24 threaded connection
26 disposable tab
28 aperture
30 inner cavity
32 baby bottle cap
34 baby bottle nipple

DETAILED DESCRIPTION OF THE PREFERRED EMBODIMENT

Turning now descriptively to the drawings, in which similar reference characters denote similar elements throughout the several views. FIGS. 1 through 9 illustrate the sealable baby bottle liner of the present invention indicated generally by the numeral 10.

FIG. 1 is a perspective view of the sealable baby bottle liner 10 of the present invention inserted into a baby bottle 12 and used feed an infant 14. The baby bottle liner 10, when used in conjunction with a standard baby bottle 12, prevents or reduces the ingestion of air by a baby 14. The baby bottle liner 10 is sterilized by the manufacturer thereof and is ready for safe use by a user. The baby bottle liner 10 is reusable art thus, once used, the user may either dispose of the baby bottle liner 10 or place it in boiling water to re-disinfect it for future use. The preferred embodiment of the baby bottle liner 10 is capable of withstanding temperatures of one hundred degrees Celsius or greater without deformation or melting occurring to the containment body 11.

When used with a standard baby bottle 12, the cap of the bottle 12 grips the liner 10 in an airtight fashion. The baby bottle liner 10 collapses around the beverage 16 contained therein when the baby feeds on the bottle 12, due to the airtight enclosure. By collapsing with the beverage 16, air pockets in the liquid are eliminated, thus, preventing or reducing ingestion of air by the baby 14. Indicia, such as a measurement scale 18, are printed on the outer, surface of the baby bottle liner 10. The measurement scale 18 provides information regarding the amount of beverage 16 contained within the baby bottle liner 10 as well as an amount of liquid ingested by the baby 14. Additionally, the baby bottle liner 10 includes an interlocking seal 20. Excess beverage 16 remaining after feeding the baby 14 may be stored in the baby bottle liner 10 by pressing the interlocking seal 20 together. This creates an airtight container. Liquid is prevented from escaping the baby bottle liner 10 until a user breaks the seal prior to the next use. The date and/or time at which a beverage 16 was prepared and sealed within the baby bottle liner 10 can be recorded on an ascribable section 22 on the outer surface of the baby bottle liner 10. Indicia is provided on the baby bottle liner 10 indicating where to record the time and date. A beverage 16 sealed within the baby bottle liner 10 may be stored for long periods of time while maintaining freshness by keeping the sealed liner 10 stored at a reduced temperature or frozen at temperatures of zero degrees Celsius or lower. The content body 11 of the baby bottle liner 10 can withstand such temperatures without deformation or breaking. With the pertinent information such as the date and time of original preparation of the beverage 16 and the name of the baby for which it was prepared placed directly on the ascribable section 22 of the baby bottle liner 10, quick identification of the contents of the baby bottle liner 10 is possible as well as matching the baby bottle liner with the correct baby 14.

Figure 2:
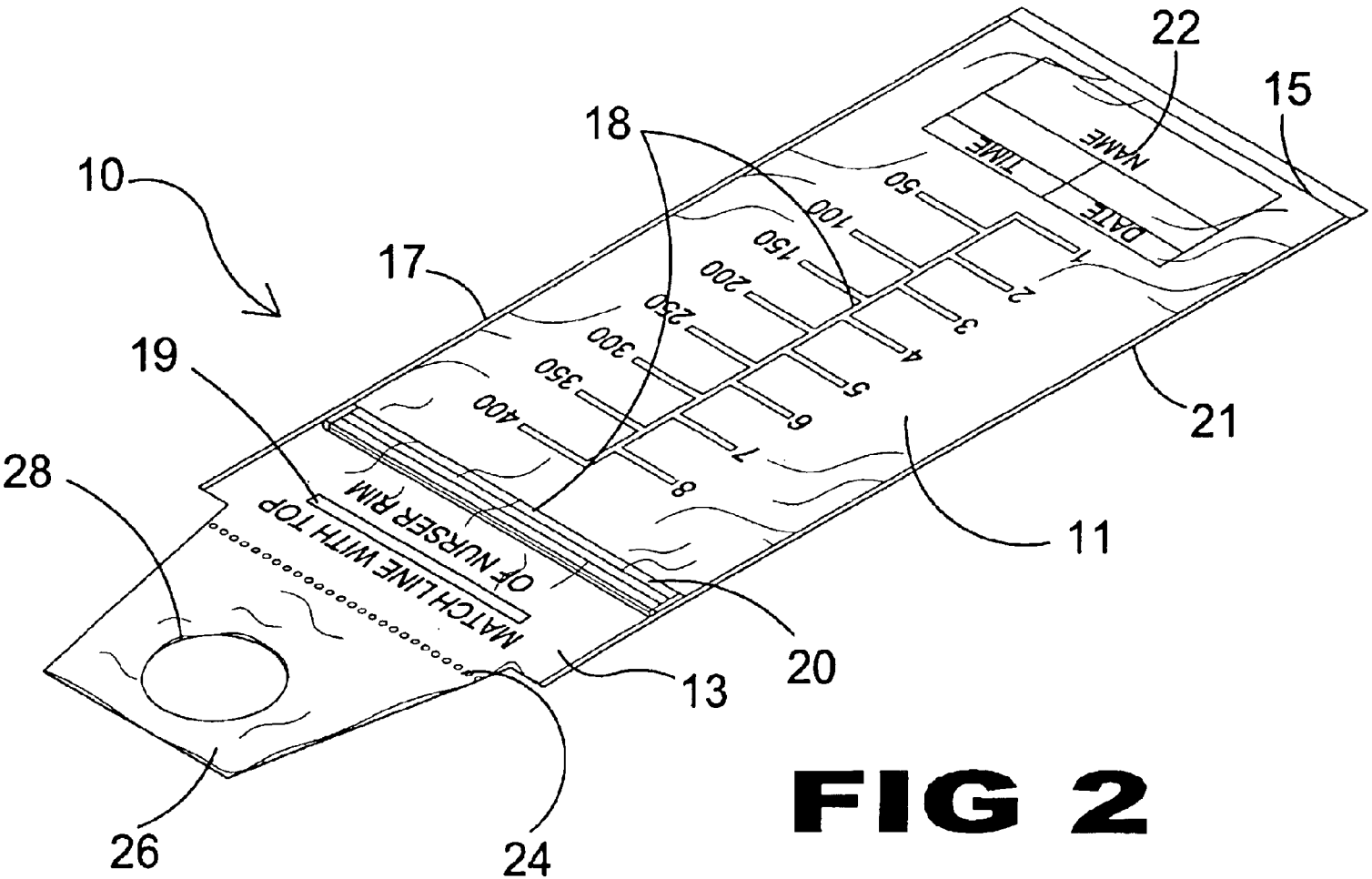
FIG. 2 is a perspective view of the sealable baby bottle liner of the present invention without any liquid therein.

FIG. 2 is a perspective view of the sealable baby bottle liner 10 of the present invention. From this figure it is seen that the baby bottle liner 10 includes a containment body 11. The containment body 11 is preferably formed of a transparent, polymeric material that allow for volumetric expansion. The containment body 11 forms an enclosed pouch having three sealed sides and a fourth open side 13. The containment body 11 is permanently sealed along a first end 15 and first and second sides, 17 and 21, respectively extending from either side of the first end 15. A second end 13 is opened and positioned between the first and second sealed sides 17 and 21, respectively, on an end opposite the first end 15. The containment body 11 has an outer surface on which indicia are printed and an inner surface creating a cavity between the three sealed sides. A selectively interlocking seal 20 is positioned on an inner surface of the containment body 11 extending along a length of the second end 13 for selectively sealing the cavity thereby creating an airtight container.

The material forming the containment body 11 extends beyond the interlocking seal 20*m* at the second side 13. This extra material provides a graspable component for facilitating installation of the baby bottle liner 10 within a bottle. A perforation 24 extends across a length of the excess material above the interlocking seal 20. Disposable tabs 26 extend above the perforation 24. The disposable tabs 26 include an, aperture 28 extending therethrough. The aperture 28 aids a user with installation of the baby bottle liner 10 into a baby bottle by providing a handle for grasping the baby bottle liner 10. Indicia providing a reference line 19 on the outer surface of the containment body 11 between the interlocking seal 20 and the perforated line 24 indicating where the top of a baby bottle should align with the baby bottle liner 10 when installed is printed on an outer surface of he baby bottle liner 10. Once positioned on a bottle with the reference line 19 aligned with the top of a baby bottle 12, the user removes the disposable tabs along the perforation 24.

Indicia printed on the outer surface of the containment body 11 may include any combination of a measurement scale 18 for determining the amount of beverage in the containment body 11, a reference line 19 printed near the second end 13 of the containment body 11 for properly aligning the open end with the opening of a bottle, and an ascribable section 22 for writing pertinent information such as the time and/or date of preparation of the beverage contained within the baby bottle liner 10. Additionally, the ascribable section 22 may contain a field for recording the name of the baby for which the beverage is prepared. This allows parents with more than one child to easily identify the correct liner 10 and thereby feed the correct formula to each child.

Figure 3:
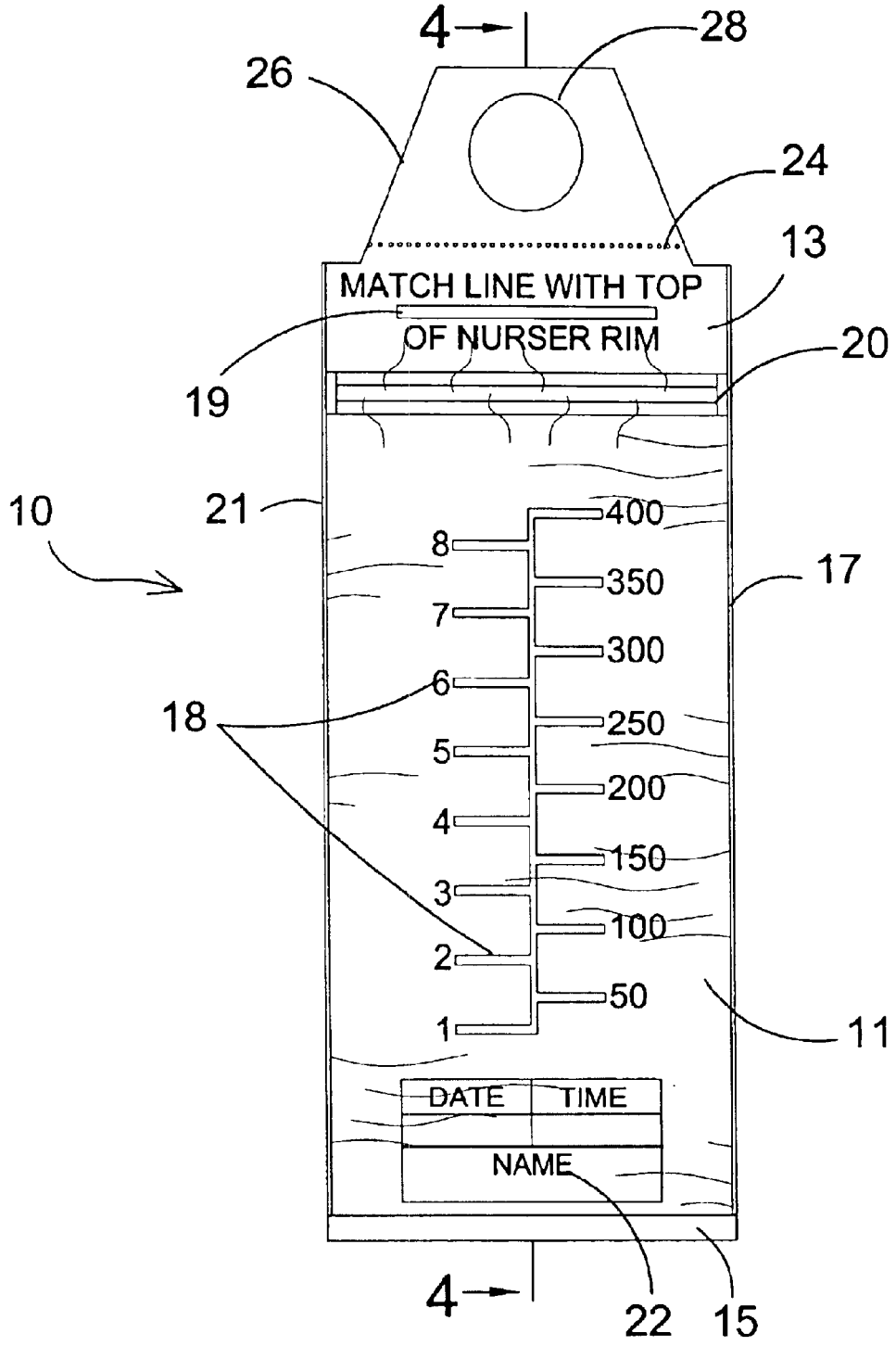
FIG. 3 is a front view of the sealable baby bottle liner of the present invention without any liquid therein.

FIG. 3 is a perspective view of the sealable baby bottle liner 10 of the present invention. From this figure it is seen that the baby bottle liner 10 includes a containment body 11. The containment body 11 is preferably formed of a transparent, polymeric material that allows for volumetric expansion. The containment body 11 forms an enclosed pouch having three sealed sides and a fourth open side 13. The containment body 11 is permanently sealed along a first end 15 and first and second sides, 17 and 21, respectively, extending from either side of the first end 15. A second end 13 is opened and positioned between the first and second sealed sides 17 and 21, respectively, on an end opposite the first end 15. The content body 11 has an outer surface on which indicia are printed and an inner surface creating a cavity between the three sealed sides. A selectively interlocking seal 20 is positioned on an inner surface of the containment body 11 extending along a length of the second end 13 for selectively sealing the cavity thereby creating an airtight container.

The material forming the containment body 11 extends beyond the interlocking seal 20 at the second side 13. This extra material provides a graspable component for facilitating installation of the baby bottle liner 10 within a bottle. A perforation 24 extends across a length of the excess material above the interlocking seal 20. Disposable tabs 26 extend above the perforation 24. The disposable tabs 26 include an aperture 28 extending therethrough. The aperture 28 aids a user with installation of the baby bottle liner 10 into a baby bottle by providing a handle for grasping the baby bottle liner 10. Indicia providing a reference line 19 on the outer surface of the containment body 11 between the interlocking seal 20 and the perforated line 24 indicating where the top of a baby bottle should align with the baby bottle liner 10 when installed is printed on an outer surface of he baby bottle liner 10. Once positioned on a bottle with the reference line 19 aligned with the top of a baby bottle 12, the user remove is the disposable tabs along the perforation 24.

Indicia printed on the outer surface of the containment body 11 may include any combination of a measurement scale 18 for determining the amount of beverage in the containment body 1, a reference line 19 printed near the second end 13 of the containment body 11 for properly aligning the open end with the opening of a bottle, and an ascribable section 22 for writing pertinent information such as the time and/or date of preparation of the beverage contained within the baby bottle liner 10. Additionally, the ascribable section 22 may contain a field for recording the name of the baby for which the beverage is prepared. This allows parents with more than one child to easily identify the correct liner 10 and thereby feed the correct formula to each child.

Figure 4:
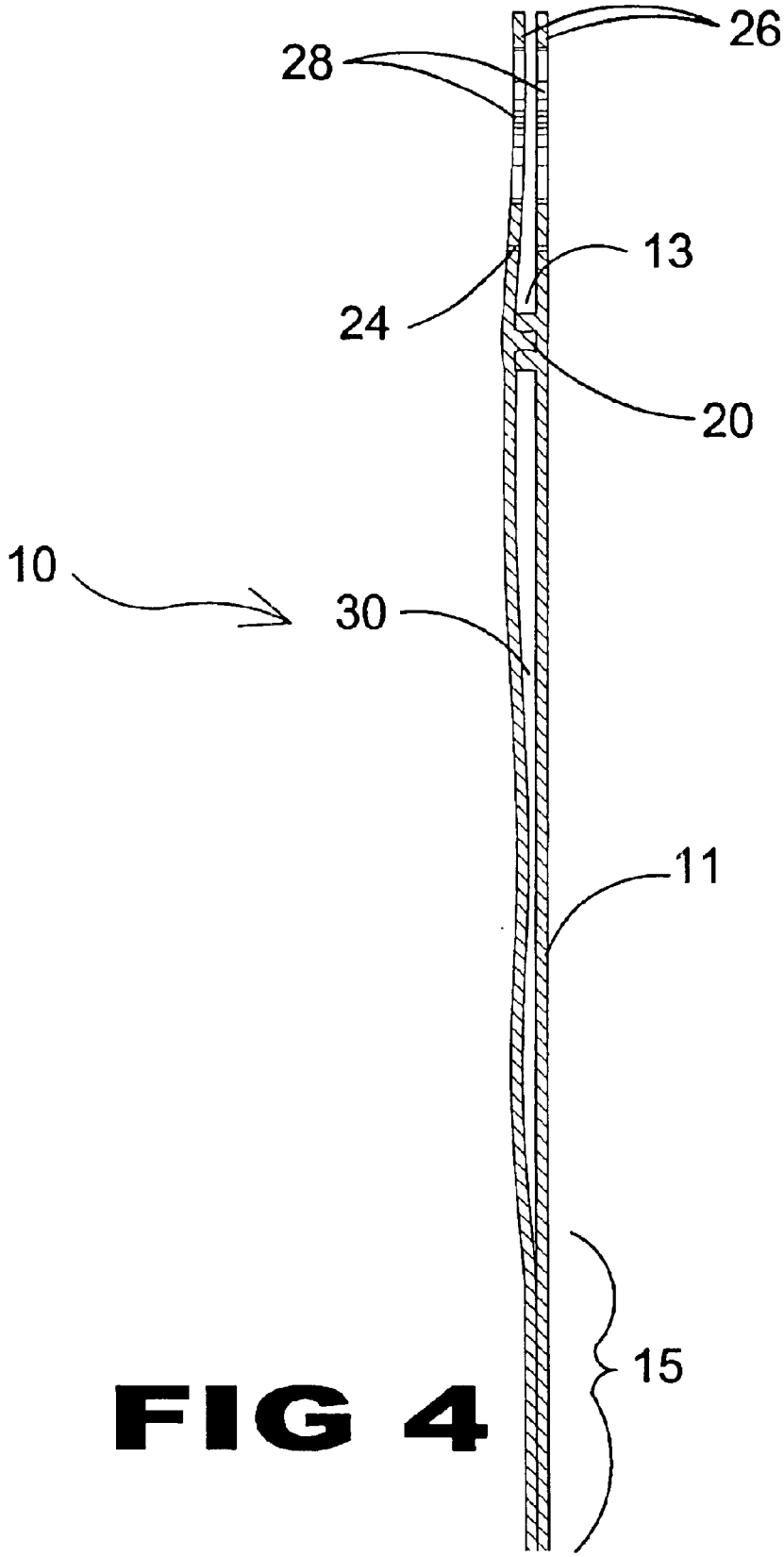
FIG. 4 is an illustrative view of a side cross sectional view of the containment body of the baby bottle liner of the present invention taken along line 4—4 of FIG. 3.

FIG. 4 is an illustrative view of a cross section of the containment body 11 of the present in invention has a containment body 111. The containment body 11 is formed by the first sealed end 15 and the first and second sealed sides (not illustrated). Opposite the first sealed end 15 is the second open end 13. A cavity 30 is formed by the inner surface of the containment body 11 between the first sealed end 15 and the first and second sealed sides. The cavity 30 is volumetrically expandable and contractible. The interlocking seal 20 is located inward of the cavity opening 13 for providing selective closure of the cavity 30. When closed, the cavity is able to store and contain unused beverage positioned therein for use at a later time. Further defining the cavity opening 13 are disposable tabs 26 provided by excess material extending beyond the interlocking seal 20. The tabs 26 are equipped with an aperture 28. The aperture 28 aids the user in installation of the baby bottle liner 10 within a baby bottle by allowing for griping of the baby bottle liner 10. Between the opening 13 to the cavity and the disposable tab 26 a perforation 24 is provided extending across a length of the containment body 11. The perforation forms a tear strip for easily detaching the disposable tabs 26 from the containment body 11 after installation.

Figure 5:
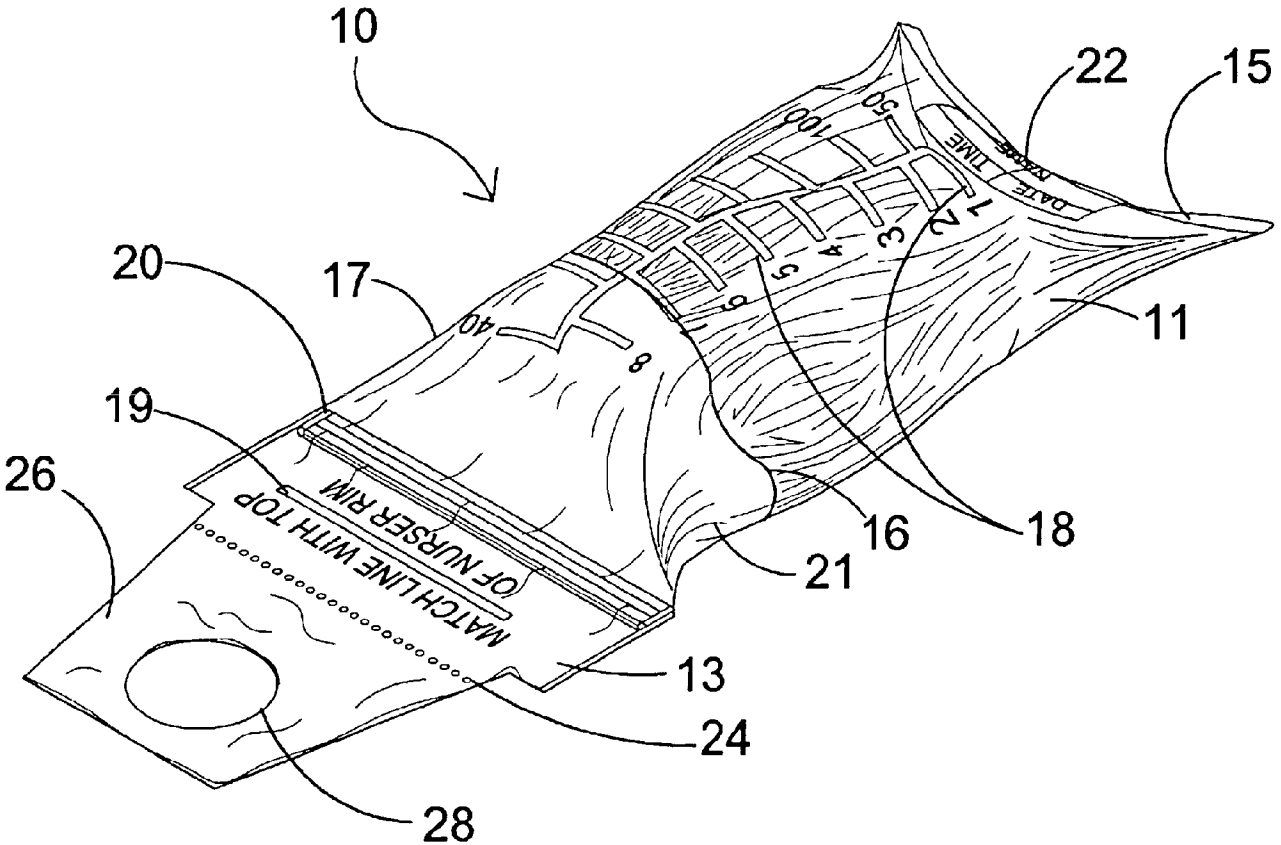
FIG. 5 is a perspective view of the sealable baby bottle liner of the present invention with a liquid sealed therein.

FIG. 5 is a perspective view of the scalable baby bottle liner 10 of the present invention. From this figure it is seen that the baby bottle liner 10 includes a containment body 11. The containment body 11 is preferably formed of a transparent, polymeric material that allows for volumetric expansion. The containment body 11 forms an enclosed pouch having three sealed sides and a fourth open side 13. The containment body 11 is permanently sealed along a first end 15 and first and second sides, 17 and 21, respectively extending from either side of the first end 15. A second end 13 is opened and positioned between the first and second sealed sides 17 and 21, respectively, on an end opposite the first end 15. The containment body 11 has an outer surface on which indicia are printed and an inner surface creating a cavity between the three sealed sides. A selectively interlocking seal 20 is positioned on an inner surface of the containment body 11 extending along a length of the second end 13 for selectively sealing the cavity thereby creating an airtight container.

The material forming the containment body 11 extends beyond the interlocking seal 20 at the second side 13. This extra material provides a graspable component for facilitating installation of the baby bottle liner 10 within a bottle. A perforation 24 extends across a length of the excess material above the interlocking seal 20. Disposable tabs 26 extend above the perforation 24. The disposable tabs 26 include an aperture 28 extending therethrough. The aperture 28 aids a user with installation of the baby bottle liner 10 into a baby bottle by providing a handle for grasping the baby bottle liner 10. Indicia providing a reference line 19 on the outer surface of the containment body 11 between the interlocking seal 20 and the perforated line 24 for indicating where the top of a baby bottle should align with the baby bottle liner 10 when installed is printed on an outer surface of he baby bottle liner 10. Once positioned on a bottle with the reference line 19 aligned with the top of a baby bottle 12 the user remove the disposable tabs along the perforation 24.

Indicia printed on the outer surface of the containment body 11 may include any combination of a measurement scale 18 for determining the amount of beverage in the containment body 11, a reference line 19 printed near the second end 13 of the containment body 11 for properly aligning the open end with the opening of a bottle, and an ascribable section 22 for writing pertinent information such as the time and/or date of preparation of the beverage contained within the baby bottle liner 10. Additionally, the ascribable section 22 may contain a field for recording the name of the baby for which the beverage is prepared. This allows parents with more than one child to easily identify the correct liner 10 and thereby feed the correct formula to each child.

As illustrated, the containment body 11 is in an expanded form to accommodate a liquid 16 therein. Preferably the baby bottle liner 10 is formed of a polymeric material that allows for the cavity to expand in order to accommodate a predetermined amount of liquid 16 that may be poured therein. The liquid 16 may be stored for use at a later date by sealing the interlocking seal 20. The time and date of initial preparation may be indicated on the ascribable area 22 of the baby bottle liner 10. This allows for liquids 16 to be prepared in advance of feedings without the fear of the liquid spoiling, becoming disinfected, or spilling. Often a baby's diet is tailored to their age and dietary needs, therefore a name field is provided within the ascribable section 22 on the baby bottle liner 10. The baby bottle liner 10 is designed to be received within a standard baby bottle. The baby bottle liner 10 may also be produced in various sizes to be received with in baby bottles of different sizes.

Figure 6:
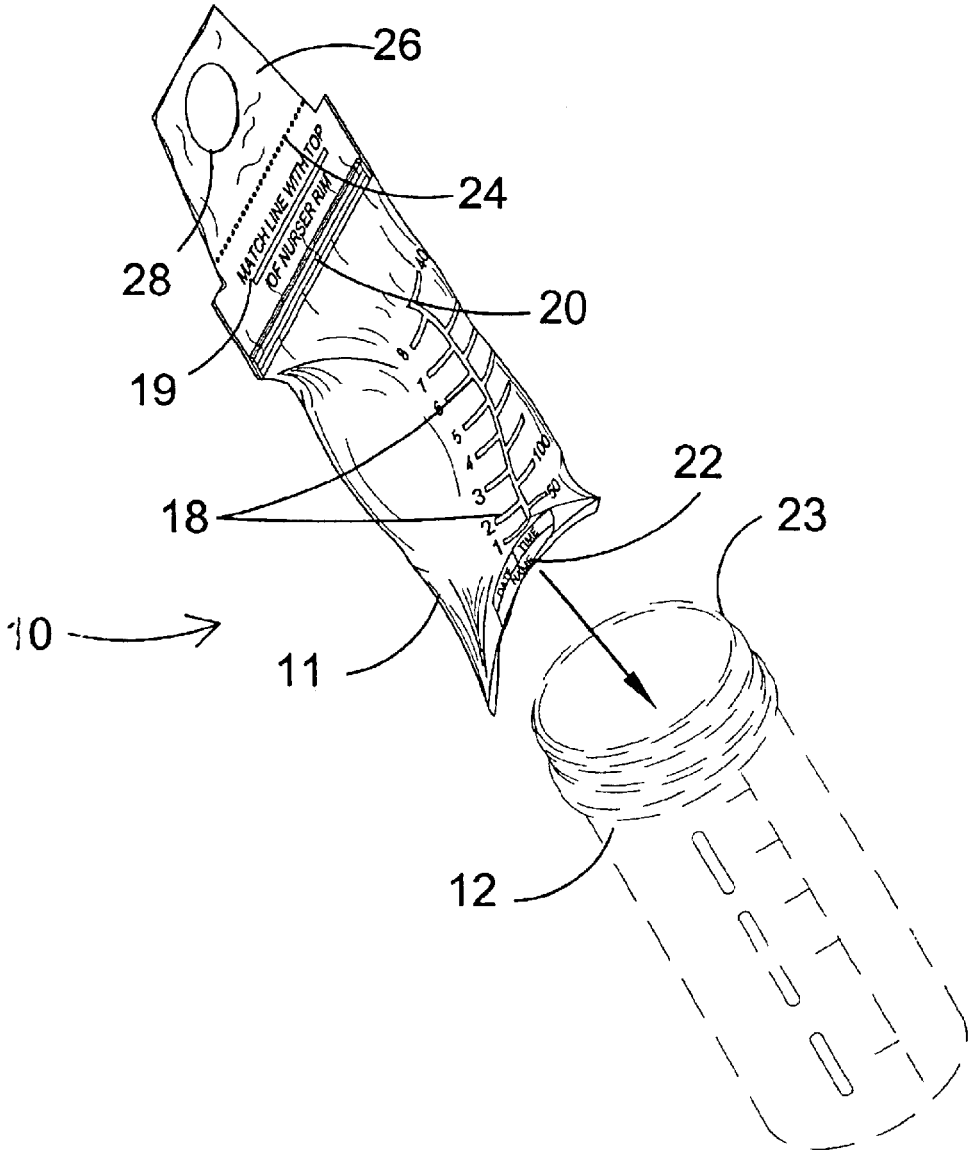
FIG. 6 is a perspective view of the sealable baby bottle liner of the present invention containing a beverage sealed therein being placed into a baby bottle.

FIG. 6 is a perspective view of the sealable baby bottle liner 10 of the present invention containing a liquid 16 sealed therein being placed into a baby bottle 12. By sealing the interlocking seal 20 after filling the baby bottle liner 10 with a liquid 16, the baby bottle liner 10 can be placed into a bottle 12 without the fear of spilling the liquid 16 there from. The containment body 11 is formed to hold a predetermined volume of liquid and is sized to fit through the opening of a standard baby bottle 12 when filled. The apertures 28 extending through the disposable tabs 26 aid in insertion of the baby bottle liner 10 within a baby bottle 12 by providing a graspable component for receiving the user's fingers. The baby bottle liner 10 is determined to be completely inserted once the reference line 19 is in alignment with the top of the bottle 12. At that point, the disposable tabs 26 are pulled apart thereby opening the interlocking seal 20 and separating the tabs 26 for installation over the rim 23 of the baby bottle 12. The tabs 26 may then be separated from the baby bottle liner 10 by tearing along the perforations 24.

Figure 7:
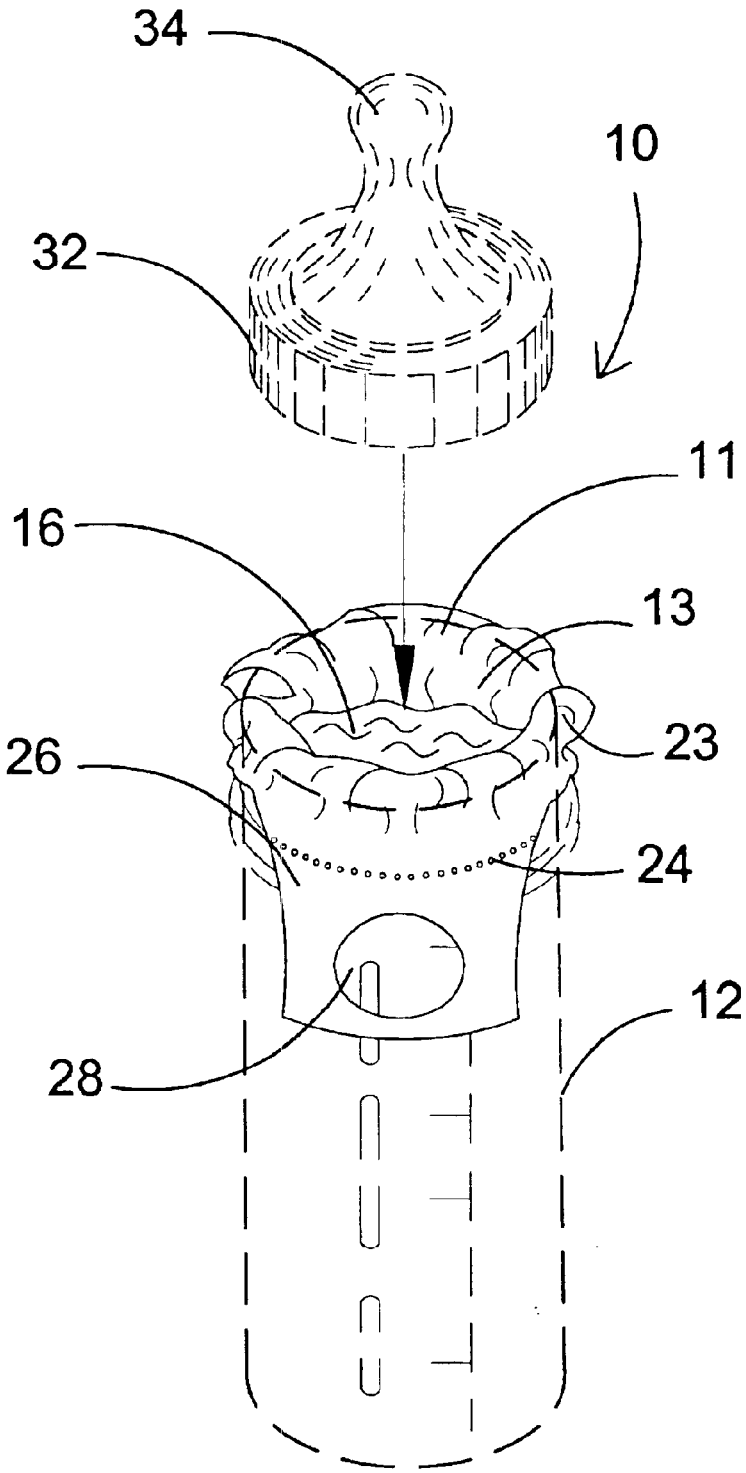
FIG. 7 is a perspective view of the sealable baby bottle liner of the present invention in a preliminary stage of installation in a baby bottle.

FIG. 7 is a perspective view of the sealable baby bottle liner 10 of the present invention installed in a baby bottle 12. As illustrated, the containment body 11 has been inserted into the baby bottle 12 as described in FIG. 6. The tabs 26 are separated and folded over the rim 23 of the baby bottle 12. Folding the tabs 26 over the rim 23 of the bottle 12 is performed by grabbing the tabs 26 at the aperture 28 of each tab 26 and separating the tabs 26. This action also releases the seal 20 providing access to the liquid within the baby bottle liner 10. The tabs 26 are then pulled sown over the sides of the baby bottle 12 such that the second open end 13 of the baby bottle liner 10 covers the top edge of the baby bottle 10. The liquid 16 is contained within the containment body 11 of the baby bottle liner 10. The baby bottle cap 32 is then placed over the rim 23 of the bottle 12 as indicated by the arrow and rotated to mesh threads on an inner side of the cap with threads on an outer side of the top edge of the baby bottle 12 capturing the open end 13 of the containment body 11 between the bottle 12 and the cap 32 and sealing the baby bottle 12.

Figure 8:
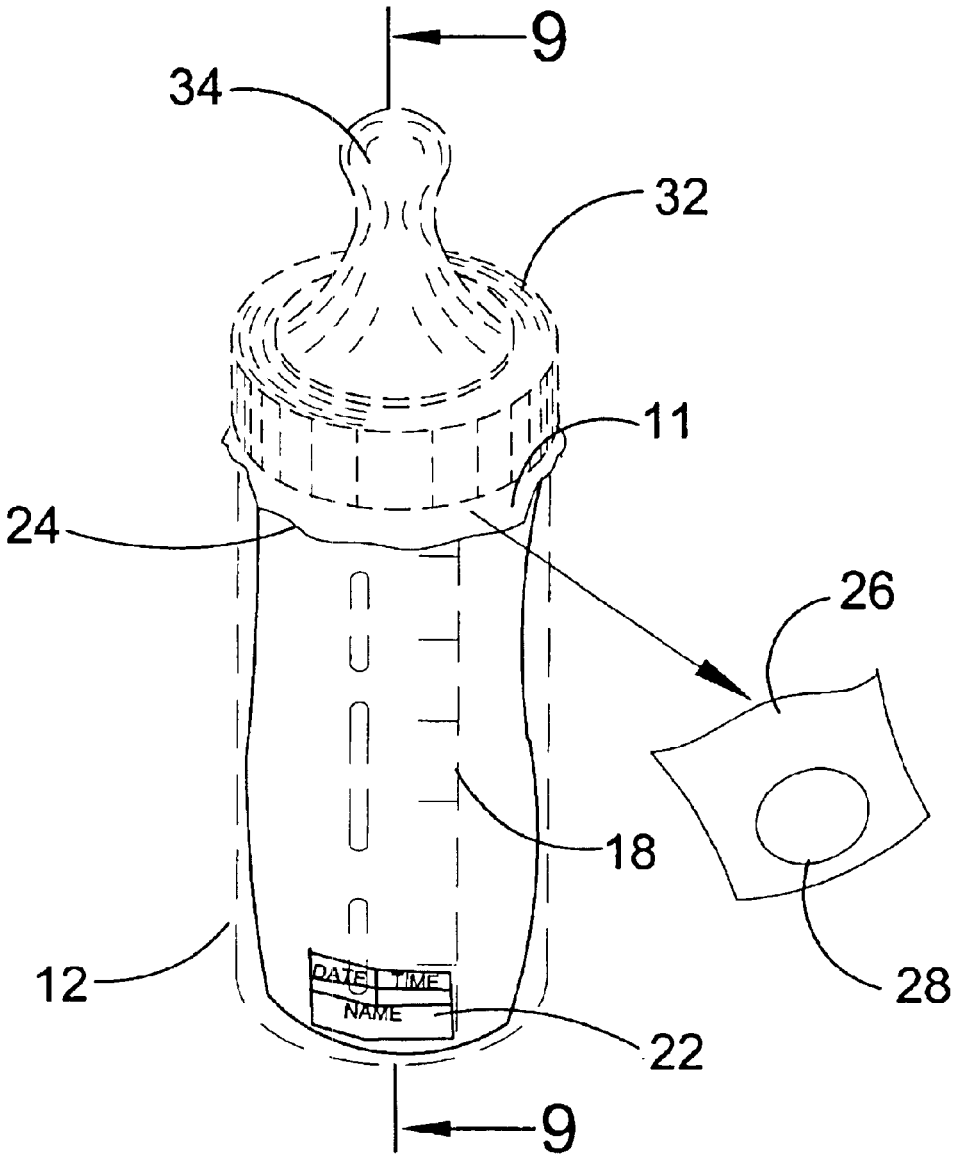
FIG. 8 is a perspective view of a baby bottle having the baby bottle liner of the present invention installed therein with disposable tabs removed.

FIG. 8 is an illustrative view of the sealable liner 10 of the present invention completely installed in a baby bottle 12 and its disposable tabs 26 removed. Shown is the baby bottle liner 10 fully installed in a baby bottle 12 being suspended and held in place by the placement of the baby bottle cap 32 onto the baby bottle 12 while gripping the containment second open end 13 of the body 11 there between. Additionally shown is a disposable tab 26 being removed from the containment body 11 after installation to eliminate any form of hazard or choking risk to a child. The tab 26 is easily broken away from the containment body 11 by tearing the containment body 11 along the perforation 24 by pulling on the aperture 28. With the bay liner 10 secured in the bottle 12 by the cap 32, the open end 13 of the liner 10 is sealed from spilling except for the small hole in the nipple 34 within the cap 32. Therefore, when the bottle 12 is inverted for feeding, the child sucks the liquid 16 contained therein through the nipple 34.

Additionally illustrated is the customary transparent bottle 12. Because the bottle 12 is transparent, the measurement indicia 18 on the side of the baby bottle liner 10 are viewable therethrough. Further, the date and time of preparation, as well as the name of the intended child as indicated on the ascribable section 22 of the baby bottle liner 10 may be verified before issuing the bottle for feeding.

Figure 9:
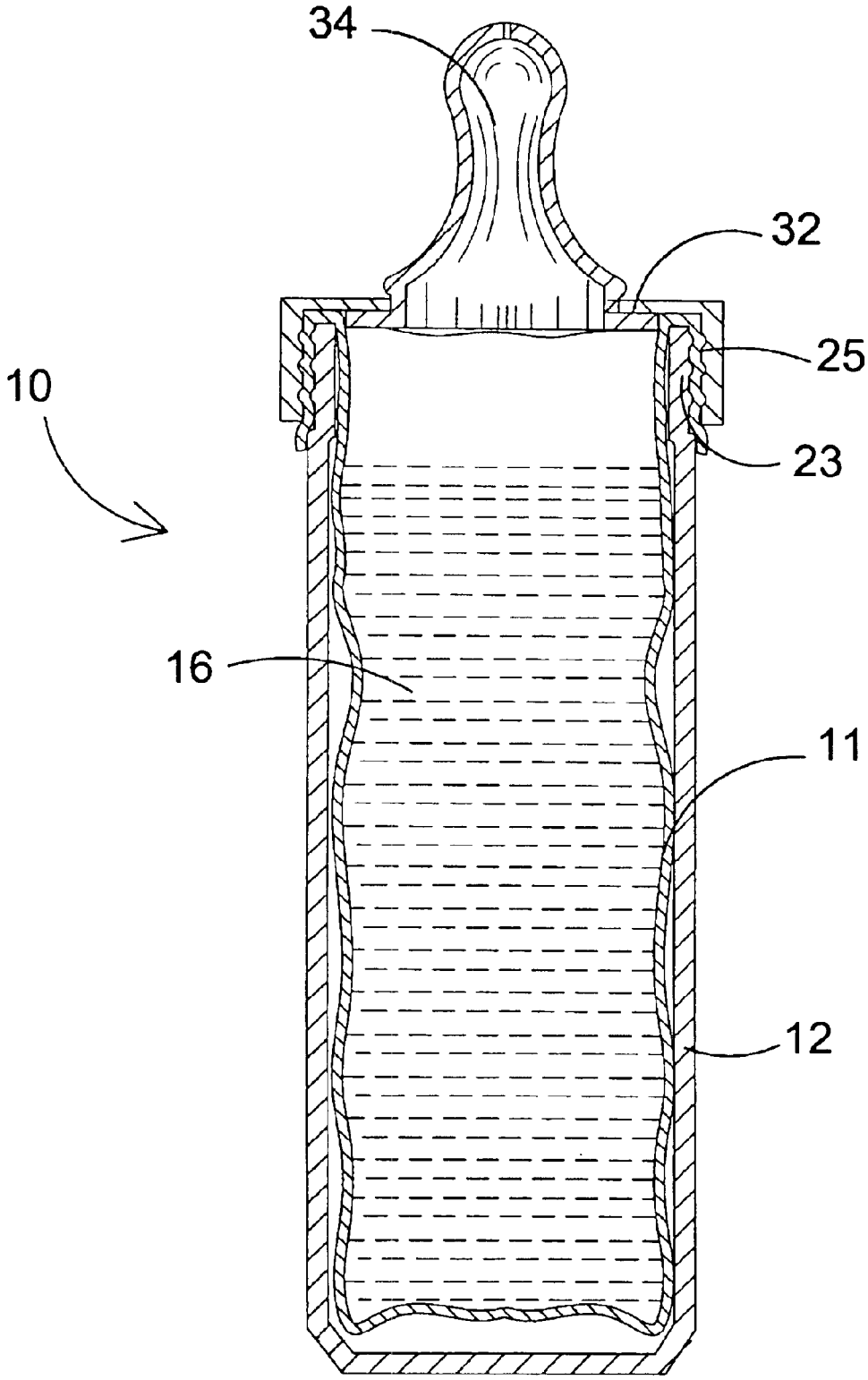
FIG. 9 is a side cross sectional view of the baby bottle liner of the present invention installed in a baby bottle taken along line 9—9 of FIG. 8.

FIG. 9 is a cross section view along line 9 illustrated in FIG. 8 of the baby bottle liner 10 of the present invention installed in a bottle 12. Shown is the baby bottle liner 10 fully installed inside a baby bottle 12 with the cavity 30 of the containment body containing a liquid 16. The cavity's opening 13 is secured between the rim 23 of the baby bottle 12 and the cap 32 by the threaded connection 25 therebetween. An airtight seal is formed between the cap 32 and bottle 12 to prevent the introduction of air into the bottle to mix with the liquid. Upon sucking of the nipple by a baby, the liquid is caused to pass through a hole in the nipple 34, for feeding a child. Not illustrated are the tabs 26 which nave been removed from the containment body 11 as described in FIG. 8.

In operation, a liquid is poured into the open end of the cavity of the liner of the present invention. The user determines the amount of beverage poured therein by comparing the line of the liquid to the measurement indicia printed on the liner. The user has the option of installing the liner containing a desired quantity of liquid in a baby bottle for dispensing, or the user may seal the sealable liner for future use at a selected time. If the user decides to store the beverage for use at a later time, the user seals the liner with the beverage contained therein by running two fingers on either side of the interlocking seal. Pressing the two sides of the seal interlocking together creates an airtight seal, thus, transforming the cavity into an airtight container. Preferably containment body is formed of a material capable of volumetric expansion. The containment body is able to withstand temperatures within a minimum range of substantially 0°–100° degrees Celsius. However, the range of temperatures that baby bottle liner can with stand without deformation is preferably extends below zero degrees Celsius and above one hundred degrees Celsius. Because the liner can withstand freezing temperatures, the stored beverage therein can be frozen for prolonged storage. In addition, because the liner can withstand at least one hundred degrees Celsius, the liner can be boiled thereby disinfecting the contents.

When the liner is to be used for dispensing the beverage contained within, the liner is removed from the storage location, if stored. The liner is preferably immersed in boiling water or placed in a refrigerator and later removed when the beverage contained within reaches a desired temperature or is adequately disinfected. The apertures on the tabs are then grasped and the tabs are pulled apart from one another to open the interlocking seal. The temperature of the beverage may be verified by immersing a thermometer or a finger therein. Running two fingers along the interlocking seal now reseals the liner. By doing so, the sealed liner can be inserted into a baby bottle without concern for spilling the beverage therein. Then liner is inserted in the baby bottle to a point at which until the rim of the baby bottle is aligned with the corresponding reference line on the liner. The user then pulls apart the tabs with enough force to separate the two sides of the interlocking seal. This is easily achieved by pulling with a finger from each aperture. The containment body is now inside the bottle and the opening is positioned adjacent the rim. Still holding the tabs at the aperture, the tabs are pulled over the rim and positioned along the side of the bottle. The user then pinches the two tabs to the side of the bottle with two fingers, allowing the cavity containing the beverage to remain suspended from the rim of the bottle. The baby bottle cap is then positioned over the rim of the baby bottle with the nipple pointing upward. The cap is then screwed onto the threaded rim of the bottle until it cannot be screwed on any further. The material of the liner is now pinched between the cap and the rim of the bottle creating an airtight seal and suspending the cavity therefrom. The tabs are removed from the bottle by tearing the tabs at the perforation thereby separating the tabs from the containment body of the liner. The bottle can now be inverted for dispensing the liquid contained therein through the nipple. The amount of beverage dispensed from the liner can be determined by comparing the level of the beverage contained therein with the initial level prior to feeding. If the entire beverage is not consumed, the remaining beverage can be saved and preserved within the liner by removing the liner from the bottle and resealing the interlocking seal. Although the tabs have been removed, still enough material protrudes from the bottle and cap that it can be grasped, thus preventing the liner from falling into the bottle when the cap is removed.

From the above description it can be seen that the sealable baby bottle liner of the present invention is able to overcome the shortcomings of prior art devices by providing a cavity for storing beverages which is sealable to produce an airtight container. Additionally, the liner of the present invention is inscribed with a measurement indicia for easily determining the amount of beverage contained therein as well as enabling a user to ascribe the date and time of preparation and the name of the respective child for which the beverage was prepared. Further, the liner of the present invention is equipped with disposable tabs that are discarded after aiding in the installation of the liner in a baby bottle. Furthermore, the sealable baby bottle liner of the present invention is simple and easy to use and economical in cost to manufacture. It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A baby bottle liner comprising:

a) a containment body including an inner surface, an outer surface, a first open end, a second sealed end, a first sealed side extending between said first open end and said second end, and a second sealed side extending between said first open end and said second sealed end on a side opposite said first sealed side thereby forming a cavity;

b) an interlocking seal positioned adjacent said first open side operable between a first position scaling said cavity and a second position providing access to said cavity;

c) a pair of tabs extending from said first open side of said containment body, each of said tabs including an aperture extending there through, wherein when said seal is in said first position an airtight container is formed preventing air from affecting liquid contained within said cavity;

d) a perforation line between said tabs and said containment body for selectively separating said tabs from said containment body; and c) a reference line spaced from and located between said interlocking and said perforation line for properly aligning the open end of said containment body with an opening into baby bottle into which said liner is to be inserted.

2. The baby bottle liner as recited in claim 1, further comprising a plurality of indicia embossed on said outer surface of said containment body including a measurement device for determining a volume of beverage contained within said cavity, an ascribable area for recording the time and date of preparation of said beverage and a name of a child for which the beverage is prepared, and a reference line for aligning with an open side of said baby bottle.

3. The baby bottle liner as recited in claim 2, wherein said containment body is adapted to be both heated to a boiling temperature of a liquid contained therein and to be cooled to a freezing temperature of a fluid contained therein.

4. The baby bottle liner as recited in claim 3, wherein said containment body is formed from a transparent material.

5. The baby bottle liner as recited in claim 4, wherein said transparent material is flexible.

6. A baby bottle in combination with a liner consisting of:

a) a baby bottle having an opening at one end thereof;

b) a containment body adapted for insertion into said baby bottle having a first open end and a second scaled end forming a cavity therebetween, said containment body being made from a transparent material capable of being heated to a boiling temperature of a liquid contained therein and cooled to a freezing temperature of said liquid;

c) an interlocking seal inside of said containment body adjacent said first open end operable between a first position sling said cavity preventing air from affecting liquid contained within said cavity and a second position providing access to said cavity;

d) a pair of tabs extending from said first open end of said containment body, each of said tabs including an aperture extending therethrough;

e) a perforation line between each of said tabs and said containment body for selectively separating said tabs from said containment body;

f) a reference line spaced from and located between said interlocking seal and a perforation line for properly aligning the open end of said containment body with an opening into said baby bottle into which said liner is to be inserted.

* * * * *